US005469832A

United States Patent [19]

Nemoto

[11] Patent Number: 5,469,832

[45] Date of Patent: Nov. 28, 1995

[54] CANISTER PURGE CONTROL METHOD AND APPARATUS FOR INTERNAL COMBUSTION ENGINE

[76] Inventor: Mamoru Nemoto, 2477-3, Aza Kashima-Yazu, Ohaza Takaba, Katsuka-Shi, Ibaraki-ken, Japan

[21] Appl. No.: 308,925

[22] Filed: Sep. 20, 1994

[30] Foreign Application Priority Data

Sep. 20, 1993 [JP] Japan ..... 5-232781

[51] Int. Cl.[6] ..... F02M 33/02

[52] U.S. Cl. ..... 123/682; 123/518; 123/519; 123/520

[58] Field of Search ..... 123/682, 518, 123/519, 520; 364/431.01, 431.03, 431.05, 431.06

[56] References Cited

U.S. PATENT DOCUMENTS

| | | | |
|---|---|---|---|
| 5,127,383 | 7/1992 | Wild | 123/682 |
| 5,172,676 | 12/1992 | Imamura | 123/682 |
| 5,195,495 | 3/1993 | Kitamoto et al. | 123/520 |
| 5,216,991 | 6/1993 | Iida et al. | 123/519 |
| 5,228,421 | 7/1993 | Orzel | 123/518 |
| 5,259,353 | 11/1993 | Nakai et al. | 123/518 |
| 5,297,528 | 3/1994 | Mukai | 123/518 |
| 5,347,974 | 9/1994 | Togai et al. | 123/682 |
| 5,351,193 | 9/1994 | Poirier et al. | 364/431.01 |

*Primary Examiner*—Raymond A. Nelli

[57] ABSTRACT

According to one embodiment of the invention, a purge quantity is controlled in proportion to an air quantity sucked into an internal combustion engine. During normal operation of the engine, a purge air-fuel ratio is calculated according to a purge rate and an air-fuel feedback control quantity. During transient operation of the engine, a target air-fuel ratio feedback control quantity is calculated according to the purge rate and the purge air-fuel ratio. When the difference between the air-fuel ratio feedback control quantity and the target air-fuel ratio feedback control quantity is greater than a predetermined value, the air-fuel ratio feedback control quantity is corrected to the target air-fuel ratio feedback control quantity. An undue fluctuation in air-fuel ratio of a fuel mixture supplied to cylinders occurring upon rapid fluctuation in purge rate can be suppressed.

15 Claims, 9 Drawing Sheets

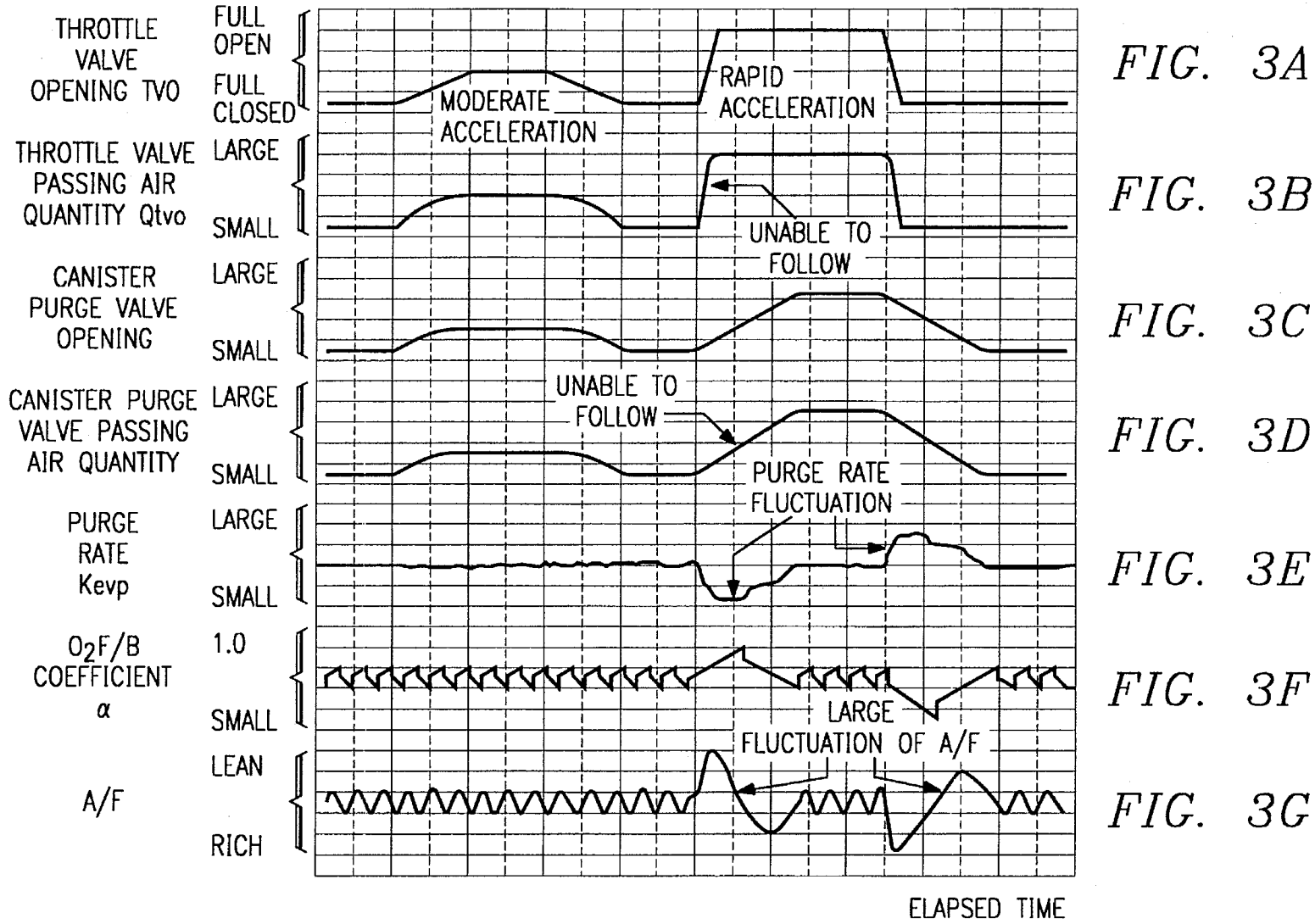
FIG. 3A
FIG. 3B
FIG. 3C
FIG. 3D
FIG. 3E
FIG. 3F
FIG. 3G
THROTTLE VALVE OPENING TVO
FULL OPEN
FULL CLOSED
RAPID ACCELERATION
MODERATE ACCELERATION
THROTTLE VALVE PASSING AIR QUANTITY Qtvo
LARGE
SMALL
UNABLE TO FOLLOW
CANISTER PURGE VALVE OPENING
LARGE
SMALL
CANISTER PURGE VALVE PASSING AIR QUANTITY
LARGE
SMALL
UNABLE TO FOLLOW
PURGE RATE Kevp
LARGE
SMALL
PURGE RATE FLUCTUATION
O2F/B COEFFICIENT α
1.0
SMALL
A/F
LEAN
RICH
LARGE
FLUCTUATION OF A/F
ELAPSED TIME THROTTLE VALVE OPENING TVO
FULL OPEN
FULL CLOSED
THROTTLE VALVE PASSING AIR QUANTITY Qtvo
LARGE
SMALL
CANISTER PURGE VALVE OPENING
LARGE
SMALL
CANISTER PURGE VALVE PASSING AIR QUANTITY Qevp
LARGE
SMALL
PURGE RATE Kevp
LARGE
SMALL
O2F/B COEFFICIENT α
1.0
SMALL
A/F
LEAN
RICH
CORRECTION TO TARGET α
SMALL FLUCTUATION OF A/F
ELAPSED TIME

CANISTER PURGE CONTROL METHOD AND APPARATUS FOR INTERNAL COMBUSTION ENGINE

BACKGROUND OF THE INVENTION

The present invention relates to a control method and apparatus in purging to an engine, a fuel vapor recovered in an automobile fuel vapor recovering device, and preferably to a fuel injection control method and apparatus.

It is known that a fuel vapor generated from an automobile fuel tank reacts with an ultraviolet radiation to generate a photochemical smog, causing air pollution. Accordingly, in most countries, an emission quantity of the fuel vapor from an automobile is regulated to a given value to prevent environmental disruption.

As means to cope with the regulation of the emission quantity of the fuel vapor, an automobile fuel vapor recovering device as described in Japanese Patent Laid-open No. Sho 57-86555 is generally known. In such a conventional automobile fuel vapor recovering device, a purge rate is controlled to a fixed value, and a canister purge valve is controlled so as to follow a change in air quantity passed through a throttle valve.

To control the purge rate to the fixed value, the canister purge valve may be controlled so as to follow the change in throttle valve passing air quantity, Qtvo. However, in the case that the canister purge valve is a stepping motor type of canister purge valve, there is a problem in responsiveness of the canister purge valve, and it is difficult to control the purge rate to the fixed value.

It is accordingly an object of the present invention to solve such a problem in the prior art and provide a canister purge control method and apparatus for an internal combustion engine with good responsiveness.

A further object is to suppress an undue fluctuation in air-fuel ratio occurring upon rapid fluctuation in purge quantity in purging to an engine a recovered fuel vapor in an automobile fuel vapor recovering device.

SUMMARY OF THE INVENTION

According to one embodiment of the present invention, an undue fluctuation in air-fuel ratio of a fuel mixture supplied to the cylinders occurring upon rapid fluctuation of a purge rate is suppressed by calculating a target $\alpha$ from estimation of a purge A/F, quickly correcting a current $\alpha$, and controlling a quantity of fuel to be injected from the injectors.

According to one embodiment of the present invention, there is provided:

a purge air-fuel ratio, estimated according to a purge rate and an air-fuel ratio feedback control quantity; and a target air-fuel ratio feedback control quantity is calculated according to the purge air-fuel ratio estimated and the purge rate in a transient operational condition of an internal combustion engine, and the air-fuel ratio feedback control quantity is corrected according to the target air-fuel ratio feedback control quantity calculated.

When the internal combustion engine is in a transient operational condition, the target air-fuel ratio feedback control quantity is calculated according to the purge air-fuel ratio estimated and the purge rate in the transient operational condition. Then, the air-fuel ratio feedback control quantity is corrected according to the target air-fuel ratio feedback control quantity calculated above. Accordingly, the responsiveness in the transient operational condition of the internal combustion engine is improved.

DESCRIPTION OF THE DRAWINGS

For a more complete understanding of the present invention and for further advantages thereof, reference is made to the following Detailed Description taken in conjunction with the accompanying drawings, in which:

FIGS. 3*a*–3*g* are time charts for explaining the principle of the present invention.

Explanation of Reference Numerals

1 . . . engine;

5 . . . throttle body;

6 . . . throttle valve;
8 . . . throttle sensor;
9 . . . suction pipe;
12 . . . injector;
13 . . . fuel tank;
22 . . . $O_2$ sensor;
30 . . . control unit;
40 . . . canister;
41 . . . canister purge valve.

It is to be noted, however, that the appended drawings illustrate only typical embodiments of this invention and are therefore not to be considered limiting of its scope, for the invention may admit to other equally effective embodiments.

DETAILED DESCRIPTION

Figure 2:
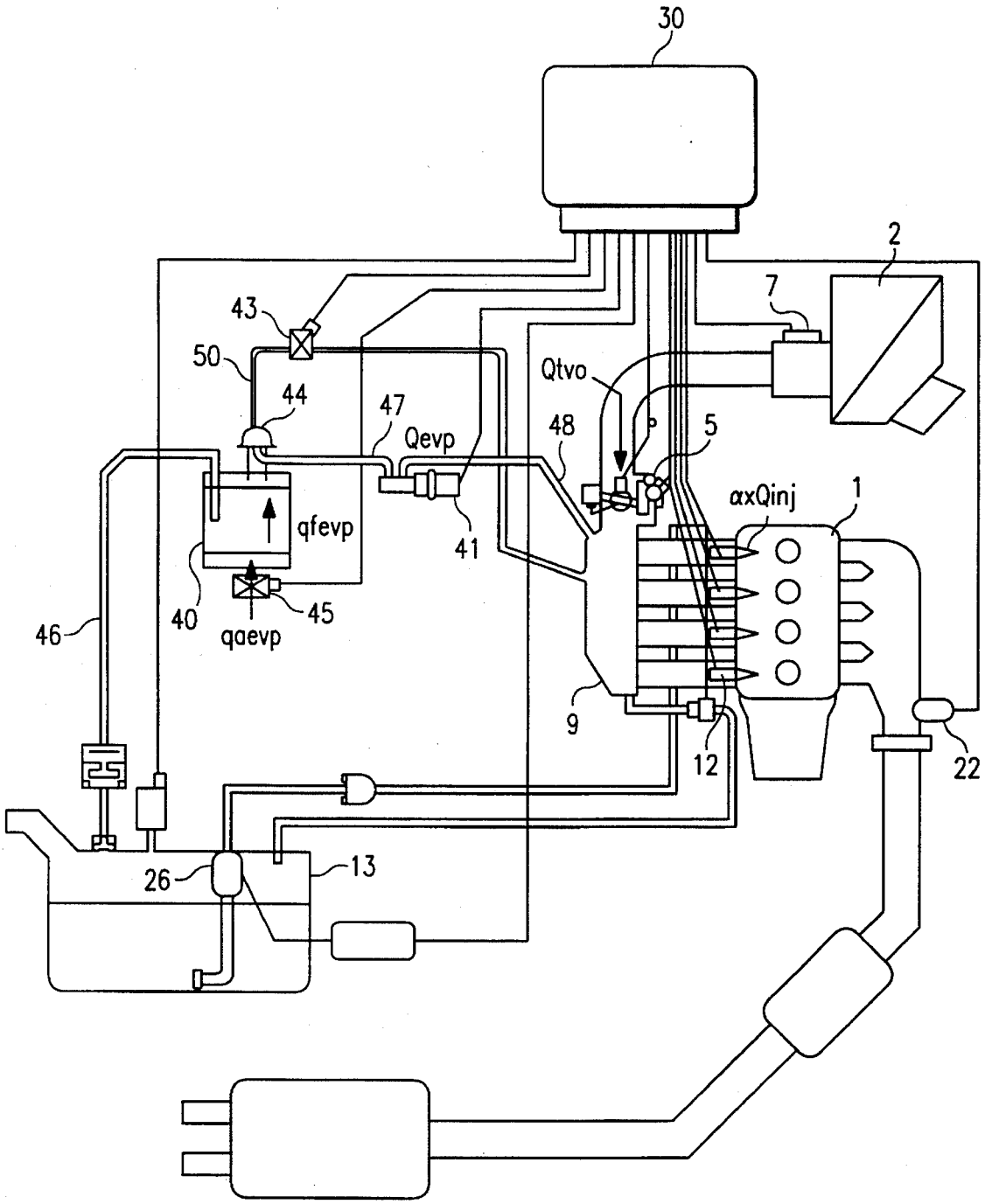
FIG. 2 is a diagram of a canister purge system, for explaining the principle of the present invention.

There is shown in FIG. 2 a diagram of a whole system structure of an automobile fuel vapor recovering device, so as to explain the principle of the present invention. First, the recovery of a fuel vapor generated from a fuel tank and the mechanism of purge of the fuel vapor will be described with reference to FIG. 2.

Reference numeral 1 denotes an engine. A suction air is controlled in quantity by a throttle valve incorporated in a throttle body 5, and is sucked through a suction pipe 9 into the engine 1.

On the other hand, a fuel vapor generated from a fuel tank 13 is temporarily recovered through a piping 46 into a canister 40. During operation of the engine 1, the fuel vapor thus recovered is introduced through a piping 47, a canister purge valve 41, and a piping 48 to the suction pipe 9 together with a fresh air introduced from a fresh air inlet 45 mounted on the canister 40. Then, the mixture of the fuel vapor and the fresh air is sucked into the engine 1 and is burned therein, thus suppressing the emission of the fuel vapor into the atmospheric air.

The canister purge valve 41 is provided to control a purge quantity with the aid of a control unit ECM 30. The purge quantity is controlled as a purge rate proportional to a suction air quantity supplied to the engine, thereby preventing an adverse effect to $O_2$ feedback. This will be described in more detail with reference to FIG. 2.

An air-fuel ratio of a fuel mixture supplied to the engine 1 is calculated from Equation (1).

$$AFcyl=(Qtvo+qaevp)/(\alpha\times Qinj+qfevp) \quad (1)$$

The symbols in Equation (1) mean the following terms in connection with the description relating to FIG. 2.

AFcyl: air-fuel ratio of a fuel mixture supplied to the engine 1
Qtvo: air quantity passed through the throttle valve
qaevp: fresh air quantity passed through the canister
$\alpha$: $O_2$ feedback coefficient
Qinj: fundamental fuel injection quantity
qfevp: fuel quantity released from the canister Then, a control equation of $\alpha$ to be controlled at a theoretical air-fuel ratio is calculated. That is, a theoretical air-fuel ratio of 14.7 for AFcyl is inserted into Equation (1) to obtain Equation (2).

$$\alpha=1+Kevp\times(AFevp-14.7)/(AFevp+1) \quad (2)$$

The symbols in Equation (2) mean the following terms in connection with the description relating to FIG. 2.

Kevp: purge ratio $$Kevp=Qevp/Otvo \quad (3)$$

Qevp: air quantity passed through the canister purge valve $$Qevp=qaevp+qfevp \quad (4)$$

AFevp: purge air-fuel ratio $$AFevp=qaevp/qfevp \quad (5)$$

Accordingly, it is understood from Equation (2) that the purge rate Kevp and the purge air-fuel ratio AFevp have an influence upon the $O_2$ feedback control factor $\alpha$.

As a result, an adverse effect on $\alpha$ can be suppressed to only a fluctuation in the purge air-fuel ratio AFevp by controlling the purge rate Kevp to a constant value, thereby improving the controllability of the $O_2$ feedback.

FIGS. 3*a*–3*g* show the behavior of the air-fuel ratio A/F in the cases of changing a throttle valve opening TVO at moderate acceleration and rapid acceleration. In the case of moderate acceleration, a change in air quantity passed through the throttle valve is also moderate, and a change in canister purge valve opening well follows the change in the above air quantity. Accordingly, the purge rate Kevp is controlled to a constant value, and the $O_2$ F/B coefficient $\alpha$ is therefore controlled at a fixed period. As a result, the air-fuel ratio A/F can be controlled within a fixed range. The need of controlling the air-fuel ratio A/F within a fixed range is a known fact in the automobile industry, and the explanation of such need will therefore be omitted.

On the other hand, in the case of rapid acceleration, the air quantity passed through the throttle valve changes rapidly as shown. However, the canister purge valve badly follows the change in the above air quantity as shown. As a result, the purge rate Kevp is fluctuated. Accordingly, when the purge rate is decreased, the air-fuel ratio AFcyl to the engine becomes Lean also as apparent from Equation (1), and the $O_2$ feedback coefficient $\alpha$ is shifted in such a direction as to increase a fuel quantity, that is, in an upward direction as shown. At this time, a speed of such shift depends on an integral correction part of feedback control, and a given period of time for such shift is therefore necessary. Accordingly, the air-fuel ratio A/F cannot be accurately controlled during this period to cause a deterioration in drivability (e.g., a reduction in output torque in the case of Lean) and a deterioration in emission control (e.g., a large emission of NOx in the case of Lean, or a large emission of CO and HC in the case of Rich).

As methods to solve the above problem, there is a method of improving the follow ability of the canister purge valve and a method of instantaneously correcting the $O_2$ feedback coefficient $\alpha$ to a proper value.

In the present invention, the above problem has been solved by the method of instantaneously correcting the $O_2$ feedback coefficient $\alpha$ to a proper value.

The proper value for $\alpha$ can be obtained by calculating the purge rate Kevp and the purge A/F AFevp from Equation (2). As is apparent from Equation (3), the purge rate Kevp is the ratio of the air quantity Qevp passed through the canister purge valve to the air quantity Qtvo passed through the throttle valve. The air quantity Qevp and the air quantity Qtvo can be calculated by recognizing the canister purge valve opening and the throttle valve opening, respectively. In the present invention, the throttle valve opening is obtained from an output from a throttle sensor to be described later and an output value from the ECM 30. On the other hand, the purge A/F may be calculated from Equation (5), but the fuel quantity qfevp released from the canister is difficult to measure. Accordingly, in the present invention, Equation (2) is modified to introduce Equation (6), from which the purge A/F is calculated in a normal operational condition of the engine.

$$AFevp=(14.7\times Kevp+\alpha-1)/(Kevp+1-\alpha) \quad (6)$$

On the basis of the above principle, the means of solving the problem according to the present invention is constituted of the following means as will be hereinafter described in detail with reference to FIG. 1.

(1) throttle valve passing air quantity calculating means
(2) canister purge quantity calculating means
(3) purge rate calculating means
(4) purge rate change quantity calculating means
(5) $O_2$ F/B coefficient α calculating means
(6) α smoothing means
(7) purge A/F estimating means
(8) target α calculating means
(9) α deviation calculating means
(10) α correcting means
(11) fuel injection duration calculating means The throttle valve passing air quantity calculating means and the canister purge quantity calculating means calculate the throttle valve passing air quantity Qtvo and the canister purge quantity Qevp, respectively, and both quantities Qtvo and Qevp are applied to the purge rate calculating means.

The purge rate Kevp calculated by the purge rate calculating means is applied to the purge rate change quantity calculating means, the purge A/F estimating means, and the target α calculating means.

The purge rate change quantity calculating means is used to distinguish a purge A/F estimation timing and a target α calculation timing, and a purge rate change quantity DKevp calculated by the purge rate change quantity calculating means acts as a starting condition for the purge A/F estimating means or the target α calculating means. More specifically, when the purge rate change quantity DKevp is less than or equal to a predetermined value, the purge A/F estimating means is started, whereas when the purge rate change quantity DKevp is greater than the predetermined value, the target α calculating means is started.

The $O_2$ F/B coefficient α calculating means is used to control an exhaust gas A/F to a value near the theoretical air-fuel ratio. Simultaneously, the calculated α is applied to the purge A/F estimating means, so as to estimate the purge A/F from Equation (6). At this time, the calculated α is smoothed by the α smoothing means, so as to improve the accuracy of estimation of the purge A/F, because the calculated α is fluctuated in the range of about +/−5% in normal F/B control. Then, the smoothed α is applied to the purge A/F estimating means.

The purge A/F estimating means calculates the purge A/F AFevp from Equation (6) by using the coefficient αave obtained by the α smoothing means and the purge rate Kevp obtained by the purge rate calculating means.

The target α calculating means calculates a target α TRGALP from Equation (2) by using the purge rate Kevp and the purge A/F AFevp.

Further, the α deviation calculating means is provided to suppress overcorrection or the like. Only when a deviation of the present controlled α from the target α TRGALP is greater than a predetermined value, the present controlled α is corrected by the α correcting means.

Finally, the fuel injection duration calculating means calculates a fuel injection duration by using the coefficient α corrected by the α correcting means, and a fuel injection valve is driven with the fuel injection duration thus calculated.

There will now be described an electronically controlled fuel injection method and apparatus having a canister purge control method and apparatus according to the present invention.

Figure 4:
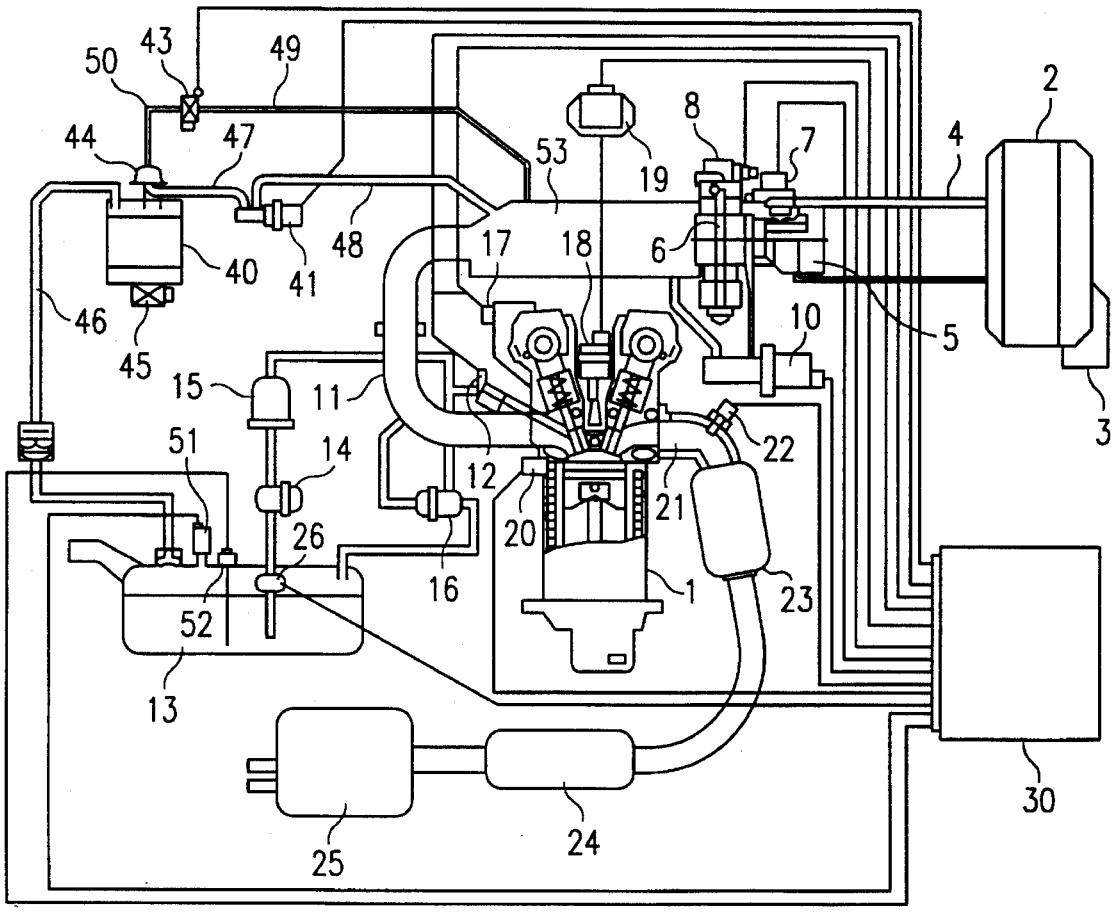
FIG. 4 is a diagram of the electronically controlled fuel injection apparatus according to the preferred embodiment of the present invention.

FIG. 4 shows a preferred embodiment of an electronically controlled fuel injection apparatus for an automobile internal combustion engine to which the present invention is applied. FIG. 4, shows an engine 1, air cleaner 2, air inlet 3, air duct 4, throttle body 5, throttle valve 6, air flow meter (AFM) 7 for measuring a suction air quantity, throttle sensor 8, surge tank 53, auxiliary air valve (ISC valve) 10, intake manifold 11, fuel injection valves (fuel injectors) 12, fuel tank 13, fuel pump 26, fuel damper 14, fuel filter 15, fuel pressure regulating valve (pressure regulator) 16, cam angle sensor 17, ignition coil 18, igniter 19, water temperature sensor 20, exhaust manifold 21, oxygen sensor 22, preliminary catalyst 23, main catalyst 24, muffler 25, and control unit 30.

A suction air is introduced from the air inlet 3 of the air cleaner 2 through the air flow meter 7 for detecting a suction air quantity and the throttle valve 6 for controlling an air flow rate into the surge tank 53. Then, the suction air is distributed by the intake manifold 11 directly communicating with cylinders of the engine 1 and is supplied into the cylinders of the engine 1. At this time, the air flow meter 7 generates a detection signal indicative of the suction air quantity, and this detection signal is input into the control unit 30.

On the other hand, fuel is sucked from the fuel tank 13 by the fuel pump 26 and is delivered under pressure through the fuel damper 14 and the fuel filter 15 to the fuel injection valves 12, from which the fuel is injected according to injection signals from the control unit 30. At this time, a fuel pressure applied to the fuel injection valves 12 is regulated by the fuel pressure regulating valve 16. The fuel pressure regulating valve 15 functions to take a vacuum in the intake manifold 11 and maintain a constant pressure difference between the fuel pressure and the vacuum in the intake manifold 11.

The throttle sensor 8 for detecting an throttle valve opening is mounted on the throttle body 5, and a signal representing the throttle valve opening is input into the control unit 30. Similarly, the ISC valve 10 is mounted to the throttle body 5 so as to bypass the throttle valve 6. The ISC valve 10 receives a signal from the control unit 30 to control an air quantity bypassing the throttle valve 6, thereby maintaining a constant idling speed.

Further, the cam angle sensor 17 generates reference signals for detection of an engine speed and for control of a fuel injection timing and an ignition timing. The reference signals are input into the control unit 30.

A temperature of the engine 1 is detected by the water temperature sensor 20, and a detection signal from the water temperature sensor 20 is input into the control unit 30.

The control unit 30 computes an optimum fuel quantity according to the above-mentioned engine condition signals (i.e., the detection signals from the air flow meter 7, the throttle sensor 8, the cam angle sensor 17, and the water temperature sensor 20), and drives the fuel injection valves 12 to supply the fuel to the engine 1. Similarly, the control unit 30 controls an ignition timing to supply current to the igniter 19 and thereby effect ignition through the ignition coil 18.

Figure 5:
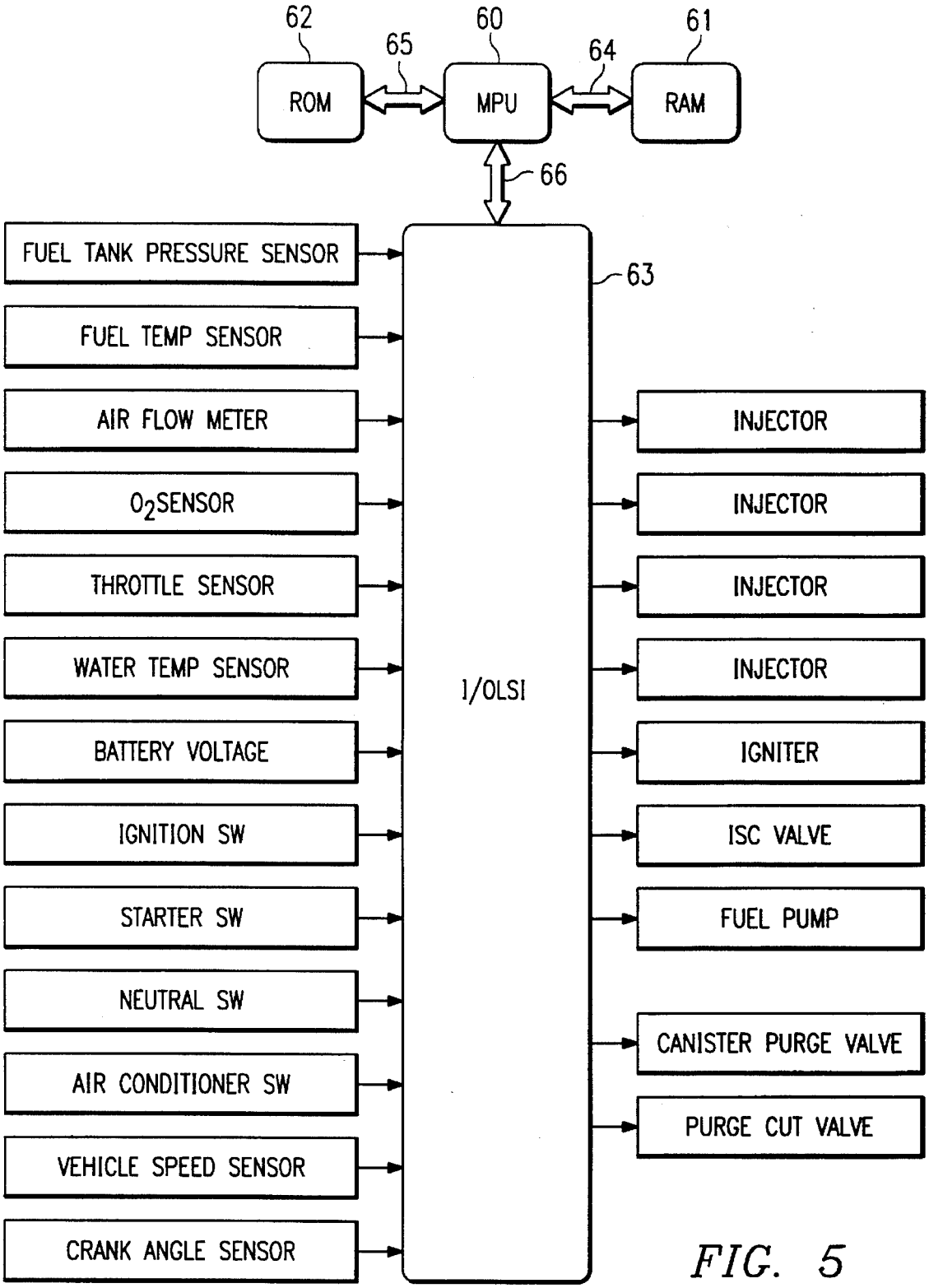
FIG. 5 is a block diagram illustrating an internal structure of a control unit in the electronically controlled fuel injection apparatus according to the preferred embodiment of the present invention.

FIG. 5 shows an internal structure of the control unit 30 in the above preferred embodiment of the present invention. An MPU 60, RAM 61 which data can be freely read to and written from, ROM 62 from which data can be read only, and I/O LSI 63 for controlling input and output are connected together through buses 64, 65, and 66, thus effecting data transmission. The MPU 60 receives the above-mentioned engine condition signals from the I/O LSI 63 through the bus 66, and sequentially reads processing contents stored in the ROM 62 to execute predetermined processing. Thereafter, the MPU 60 supplies driving signals through the I/O LSI 63 to various actuators (i.e., the injectors 12, the igniter 19, the auxiliary air valve 10, etc.).

Further, a fuel vapor recovering device shown in FIG. 4 is the same as that previously described with reference to FIG. 2; so the explanation thereof will be omitted herein.

Now, the details of each control means shown in FIG. 1 will be described.

Figure 1:
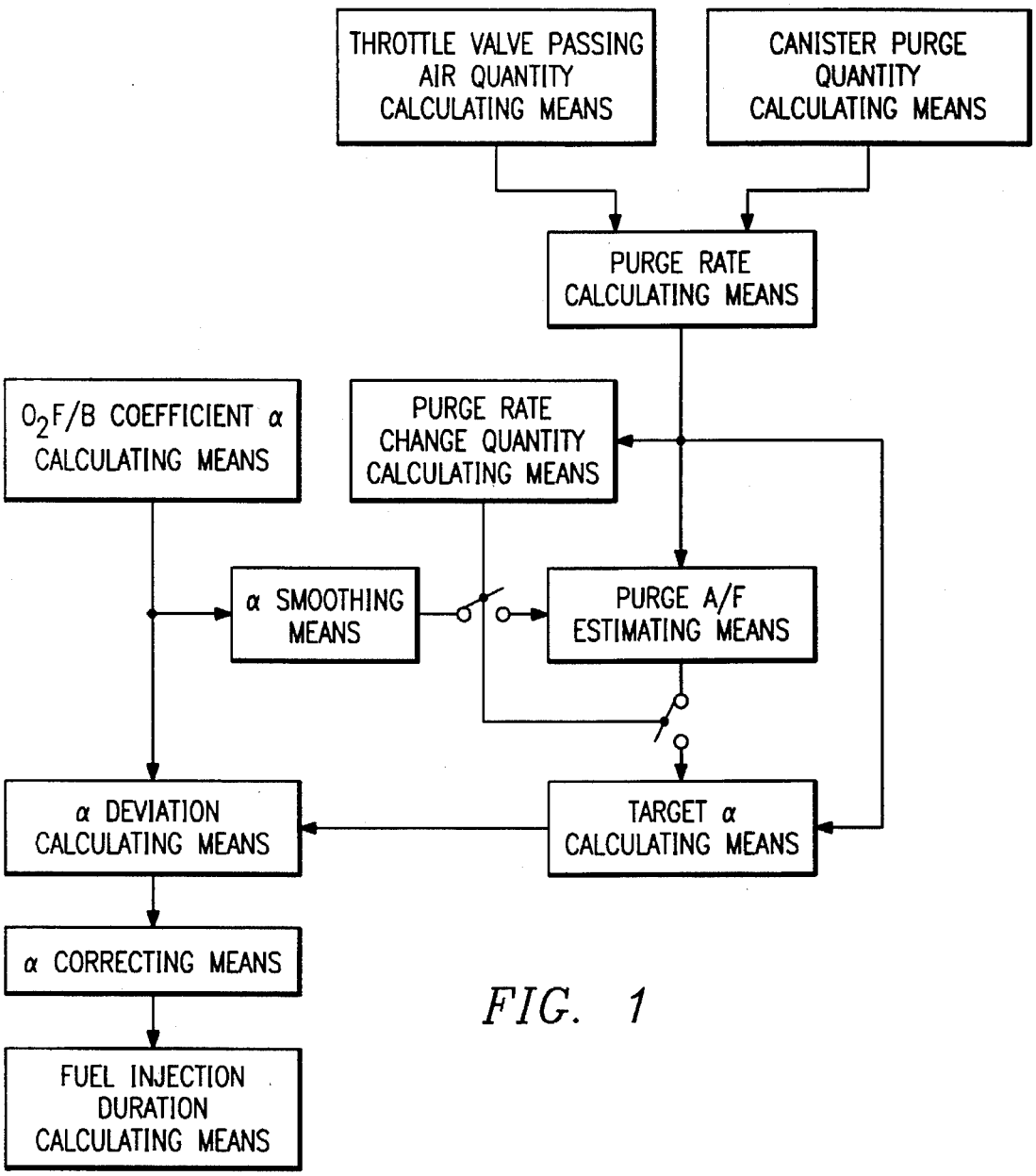
FIG. 1 is a block diagram illustrating canister purge control in a preferred embodiment of an electronically controlled fuel injection apparatus according to the present invention.
Figure 6:
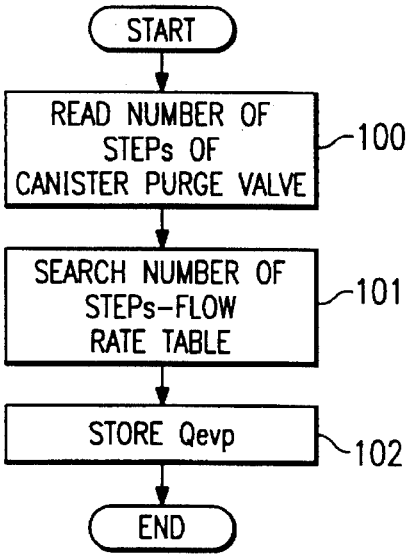
FIG. 6 is a flow chart showing a canister purge quantity Qevp calculation flow in the electronically controlled fuel injection apparatus according to the preferred embodiment of the present invention.

FIG. 6 shows a flow of calculation of the canister purge quantity Qevp, which illustrates the canister purge quantity calculating means shown in FIG. 1. In step 100, the number of steps as an output value to the canister purge valve is read. In step 101, a purge quantity Qevp is retrieved from a canister purge quantity table according to the number of steps read in step 100. The canister purge quantity table is a table in which flow rates corresponding to the numbers of steps are preliminarily stored in the ROM. In step 102, the purge quantity Qevp thus retrieved is stored into the RAM 61. Then, the flow is ended.

Figure 7:
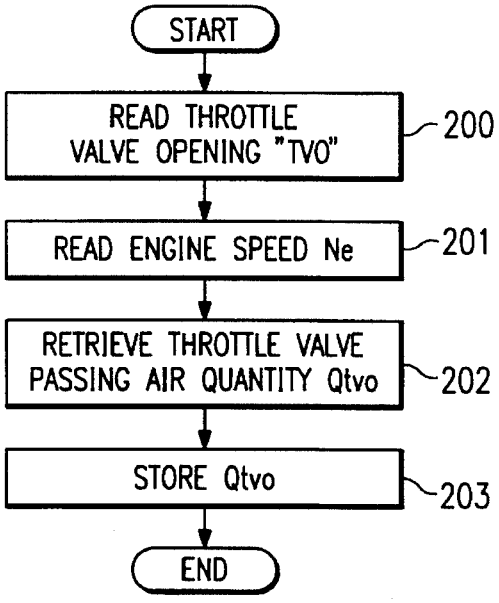
FIG. 7 is a flow chart showing a throttle valve passing air quantity Qtvo calculation flow in the electronically controlled fuel injection apparatus according to the preferred embodiment of the present invention.

FIG. 7 shows a flow of calculations of the throttle valve passing air quantity Qtvo, which illustrates the throttle valve passing air quantity calculating means shown in FIG. 1. In step 200, a throttle valve opening TVO is read. In step 201, an engine speed Ne is read. In step 202, a throttle valve passing air quantity Qtvo is retrieved from a throttle valve passing air quantity map preliminarily stored in the ROM. This map is constituted of air quantities corresponding to engine speeds and throttle valve openings. In step 203, the throttle valve passing air quantity Qtvo thus retrieved is stored into the RAM 61. Then, the flow is ended.

Figure 8:
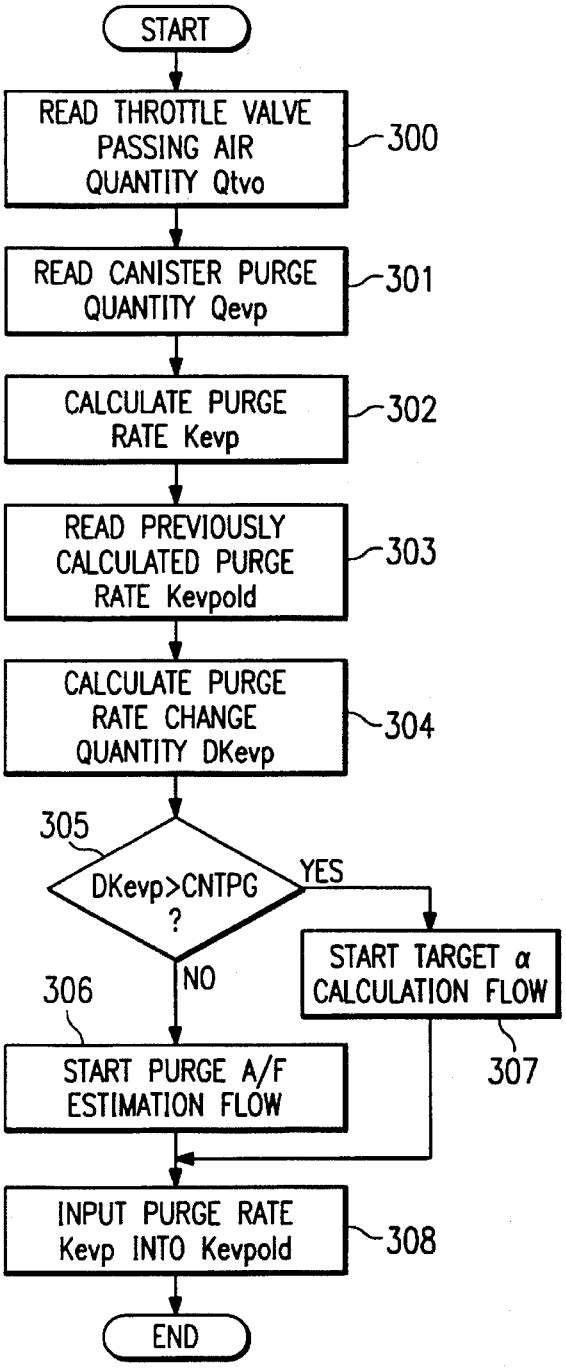
FIG. 8 is a flow chart showing a purge rate Kevp and purge rate change quantity DKevp calculation flow in the electronically controlled fuel injection apparatus according to the preferred embodiment of the present invention.

FIG. 8 shows a flow of calculations of the purge rate Kevp and the purge rate change quantity DKevp, which illustrates the purge rate calculating means and the purge rate change quantity calculating means shown in FIG. 1.

In step 300, the throttle valve passing air quantity Qtvo is read, and in step 301, the canister purge quantity Qevp is read. In step 302, the purge rate Kevp is calculated from Equation (3) using the above values Qtvo and Qevp. In step 303, a purge rate Kevpold calculated at the previous time is read, and in step 304, the purge rate change quantity DKevp is calculated from Equation (7).

$$DKevp=Kevp-Kevpold \tag{7}$$

In step 305, DKevp is compared with CNTPG, which is a value preliminarily stored in the ROM and is a piece of data from which it is determined whether or not the engine 1 is in a transient operational condition. If DKevp is less than or equal to CNTPG, a purge A/F estimation flow is started in step 306, whereas if DKevp is greater than CNTPG, a target α calculation flow is started in step 307. Then, the program proceeds to step 308, in which the purge rate Kevp calculated in step 302 is input to Kevpold. Then, the flow is ended.

Figure 9:
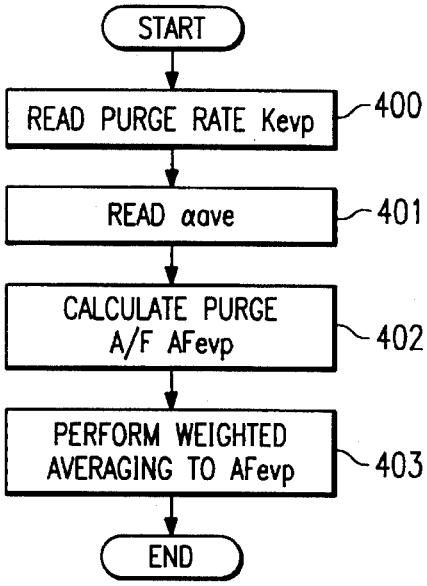
FIG. 9 is a flow chart showing a purge A/F AFevp estimation flow in the electronically controlled fuel injection apparatus according to the preferred embodiment of the present invention.

FIG. 9 shows a flow of estimation of the purge A/F AFevp, which illustrates the purge A/F estimating means shown in FIG. 1. This flow is started in step 306 shown in FIG. 8. In step 400, the purge rate Kevp is read, and in step 401, αave as α after smoothed is read. The value αave will be hereinafter described in detail with reference to FIG. 11; so the explanation thereof will be omitted herein. Then in step 402, the purge A/F AFevp is calculated from Equation (6). In step 403, the following weighted averaging to AFevp calculated in step 402 is executed. Then, the flow is ended.

(1) AFevp calculated in step 402 is moved to a register A.

(2) AFevp obtained at the previous time is read into a register B.

(3) A weighted average rate preliminarily stored in the ROM is read into a register C.

(4) The calculation of Equation (8) is executed.

$$D=C\times A+(1-C)\times B \tag{8}$$

(5) The content of the register D is input into AFevp.

Figure 10:
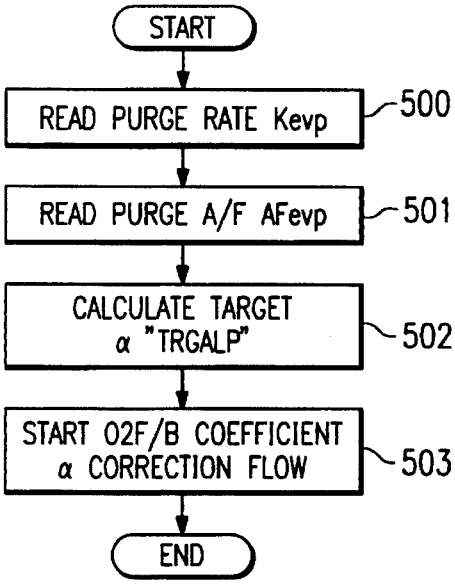
FIG. 10 is a flow chart showing a target $\alpha$ calculation flow in the electronically controlled fuel injection apparatus according to the preferred embodiment of the present invention.

FIG. 10 shows a flow of calculation of the target α, which illustrates the target α calculating means shown in FIG. 1. This flow is started in step 307 shown in FIG. 8. In step 500, the purge rate Kevp is read, and in step 501, the purge A/F AFevp is read. Then in step 502, the target α TRGALP is calculated from Equation (2). Then, the program proceeds to step 503, in which an $O_2$ F/B coefficient a correction flow (which will be hereinafter described in detail) is started. After this correction flow is terminated, the target α calculation flow is ended.

Figure 11:
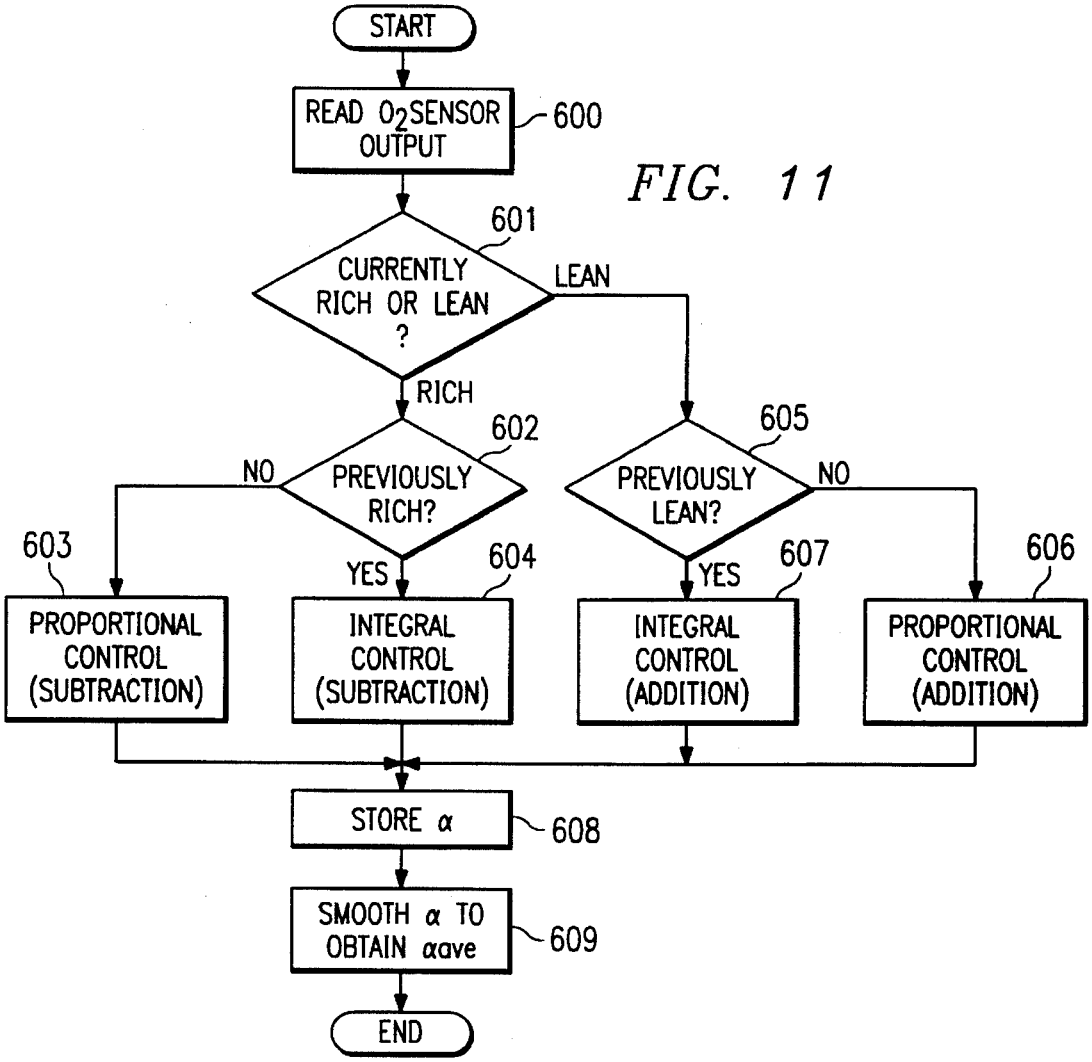
FIG. 11 is a flow chart showing an $O_2$ F/B coefficient $\alpha$ calculation flow in the electronically controlled fuel injection apparatus according to the preferred embodiment of the present invention.

FIG. 11 shows a flow of calculation of the $O_2$ F/B coefficient α, which, illustrates the $O_2$ F/B coefficient α calculating means and the α smoothing means in combination shown in FIG. 1. In step 600, an output from the $O_2$ sensor is read. In step 601, it is determined whether the air-fuel ratio is Rich (i.e., the air-fuel ratio is large) or Lean (i.e., the air-fuel ratio is small). The output from the $O_2$ sensor is a binary output such that it becomes about 0.8 V for Rich, while it becomes about 0.2 V for Lean. Therefore, the output from the $O_2$ sensor is compared with a predetermined value (about 0.5 V). If the output from the $O_2$ sensor is greater than the predetermined value, the air-fuel ratio is determined as Rich, and the program proceeds to step 602. Conversely, if the output from the $O_2$ sensor is not greater than the predetermined value, the air-fuel ratio is determined as Lean, and the program proceeds to step 605. In step 602, the processed condition at the previous time is checked. If the processed condition at the previous time is a Lean condition, it is determined that the previous Lean condition has now been changed into the current Rich condition, and the program proceeds to step 603, in which proportional control is performed. The proportional control in step 603 is performed in accordance with Equation (9).

$$\alpha=\alpha-ARP \tag{9}$$

ARP: proportional correction data in the current Rich condition, which is preliminarily stored in the ROM.

If the processed condition at the previous time is determined as a Rich condition in step 602, the program proceeds to step 604, in which integral control is performed. The integral control in step 604 is performed in accordance with Equation (10).

$$\alpha=\alpha-ARI \tag{10}$$

ARI: integral correction data in the current Rich condition, which is preliminarily stored in the ROM.

On the other hand, if the output from the $O_2$ sensor is not greater than the predetermined value, the air-fuel ratio is determined as Lean, and the program proceeds to step 605. In step 605, the processed condition at the previous time is checked similarly to step 602. If the processed condition at the previous time is a Rich condition, it is determined that the previous Rich condition has now been changed into the current Lean condition, and the program proceeds to step 606, in which proportional control is performed. The proportional control in step 606 is performed in accordance with Equation (11).

$$\alpha=\alpha+ALP \quad (11)$$

ALP: proportional correction data in the current Lean condition, which is preliminarily stored in the ROM.

If the processed condition at the previous time is determined as a Lean condition in step 605, the program proceeds to step 607, in which integral control is performed. The integral control in step 607 is performed in accordance with Equation (12).

$$\alpha=\alpha+ALI \quad (12)$$

ALI: integral correction data in the current Lean condition, which is preliminarily stored in the ROM.

Then in step 608, the value α obtained by the above processing is stored into the RAM.

Finally in step 609, smoothing of the value α is executed. In this preferred embodiment, weighted averaging is substituted for the smoothing. The procedure of the weighted averaging is the same as that of step 403; so the explanation thereof will be omitted herein.

Figure 12:
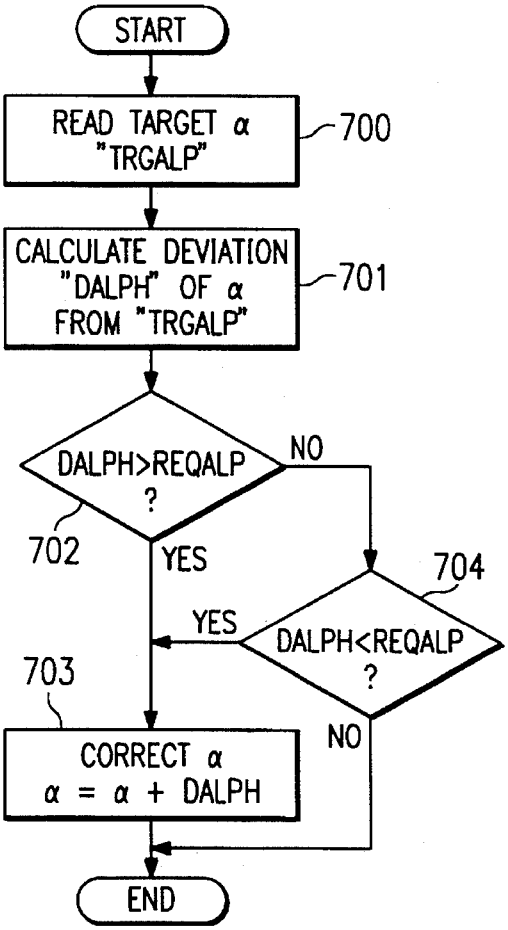
FIG. 12 is a flow chart showing an $O_2$ F/B coefficient $\alpha$ correction flow in the electronically controlled fuel injection apparatus according to the preferred embodiment of the present invention.

FIG. 12 shows a flow of correction of the $O_2$ F/B coefficient α, which illustrates the α deviation calculating means and the α correcting means in combination shown in FIG. 1. This flow is started in step 503 shown in FIG. 10. In step 700, the target α TRGALP is read. Then in step 701, a deviation DALPH of α from TRGALP is calculated from Equation (13).

$$DALPH=TRGALP-\alpha \quad (13)$$

In step 702, DALPH is compared with REQALP, which is a value preliminarily stored in the ROM and is a piece of data from which it is determined whether or not α should be corrected. If DALPH is greater than REQALP in step 702, the program proceeds to step 703, in which DALPH is added to α. Then, the flow is ended. Conversely, if DALPH is less than or equal to α in step 702, the program proceeds to step 704, in which a negative sign of DALPH is checked. That is, if DALPH is less than −REQALP in step 704, the program proceeds to step 703, whereas if DALPH is greater than or equal to −REQALP in step 704, it is determined that no correction of α is required. Then, the flow is ended.

Figure 13:
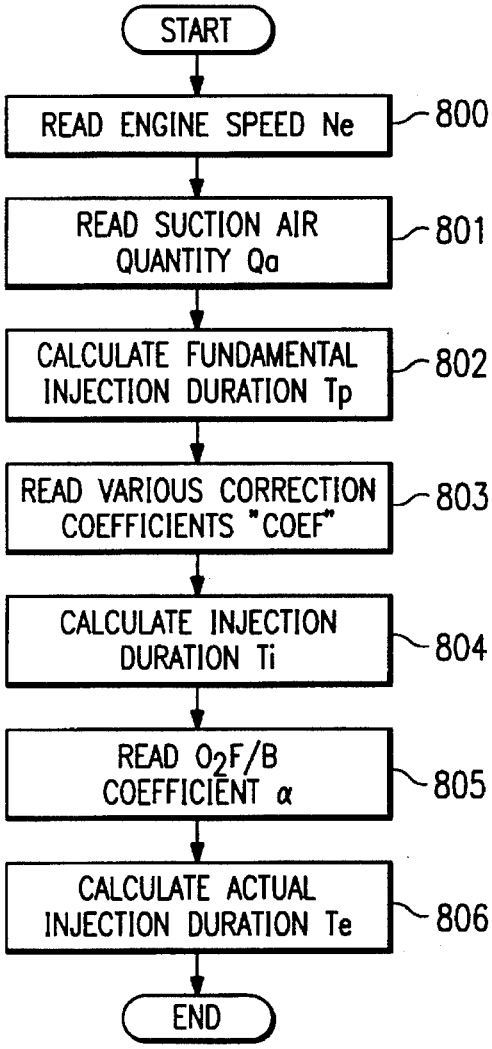
FIG. 13 is a flow chart showing a fuel injection duration calculation flow in the electronically controlled fuel injection apparatus according to the preferred embodiment of the present invention.
Figures 14A, 14B, 14C, 14D, 14E, 14F, 14G:
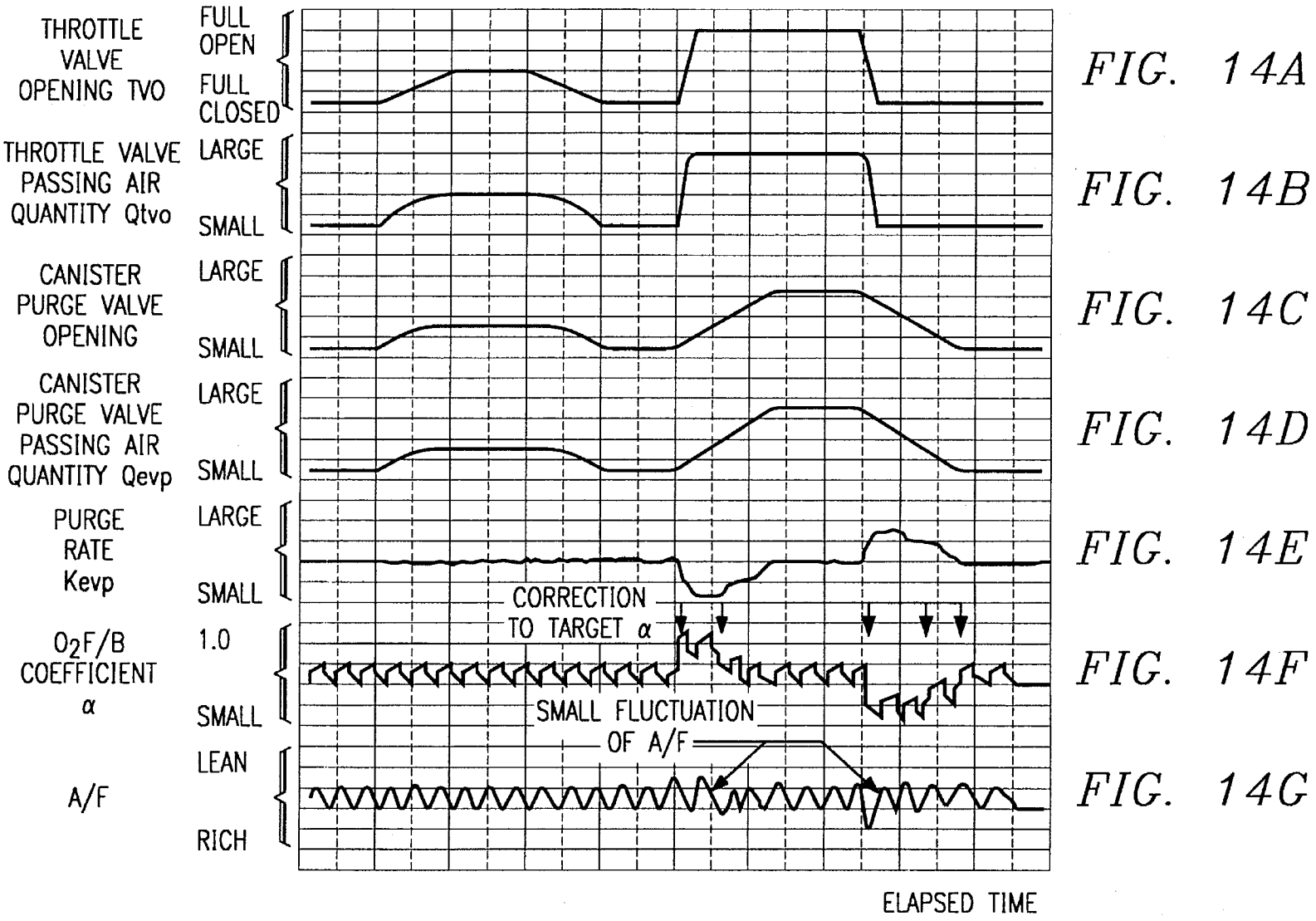
FIGS. 14*a*–14*g* are time charts illustrating an improved effect according to the present invention.

FIG. 13 shows a flow of calculation of the fuel injection duration, which illustrates the fuel injection duration calculating means shown in FIG. 1. In step 800, an engine speed Ne is read, and in step 801, a suction air quantity Qa calculated according to an output from the air flow meter 7. In step 802, a fundamental injection duration Tp is calculated from Equation (14).

$$Tp=Kinj\times Qa/Ne \quad (14)$$

Kinj: injection quantity coefficient of the injectors

In step 803, various correction coefficients COEF are read, and in step 804, an injection duration Ti is calculated from Equation (15).

$$Ti=Tp\times COEF \quad (15)$$

In step 805, the $O_2$ F/B coefficient α calculated by the α correcting means is read. In step 806, an actual injection duration Te is calculated from Equation (16).

$$Te=Ti\times\alpha+Ts \quad (16)$$

Ts: invalid pulse duration of the injectors.

Finally, the injectors are actuated by the I/O LSI 63 according to the actual injection duration thus calculated, thereby injecting the fuel.

FIGS. 14*a*–14*g* show a time chart as an example demonstrating an improved effect by the above preferred embodiment. As apparent from FIGS. 14*a*–14*g*, when the purge rate is fluctuated, the $O_2$ F/B coefficient α is instantaneously changed as shown by arrows ↓. Therefore, the fluctuation of A/F can be suppressed.

What is claimed is:

1. An engine air/fuel mixture control method comprising:

temporarily recovering a fuel vapor generated in a fuel tank to fuel vapor recovering means, purging said recovered fuel vapor to said engine during operation of said engine with a purge air quantity (Qevp) being controlled at purge ratio (Kevp) proportional to an air quantity (Qtvo) supplied to said engine, and feedback controlling an air-fuel ratio in the engine intake by a feedback control quantity (α);

said method comprising the steps of:

determining a purge air-fuel ratio (AFevp), in response to a first purge ratio (Kevp1) and a feedback control quantity (α) of said air-fuel ratio; and determining a target air-fuel ratio feedback control quantity according to said estimated purge air-fuel ratio (AFevp) and a second ratio (Kevp2); and changing said feedback control quantity (α) of said air-fuel ratio according to said calculated target air-fuel ratio feedback control quantity when Kevp1 and Kevp2 are unequal.

2. A canister purge control method for an internal combustion engine according to claim 1, wherein when a difference between said air-fuel ratio feedback control quantity and said target air-fuel ratio feedback control quantity is greater than a predetermined value, said air-fuel ratio feedback control quantity is corrected according to said target air-fuel ratio feedback control quantity calculated.

3. A canister purge control method for an internal combustion engine according to claim 2, wherein said correcting of said air-fuel ratio feedback control quantity according to said target air-fuel ratio feedback control quantity calculated comprises adjusting of said air-fuel ratio feedback control quantity to said target air-fuel ratio feedback control quantity calculated.

4. A canister purge control method for an internal combustion engine according to claim 2, wherein when a change quantity of said purge rate is greater than a predetermined value, an operational condition of said engine is determined as said transient operational condition.

5. A canister purge control method for an internal combustion engine according to claim 1, wherein said correcting of said air-fuel ratio feedback control quantity according to said target air-fuel ratio feedback control quantity calculated comprises adjusting of said air-fuel ratio feedback control quantity to said target air-fuel ratio feedback control quantity calculated.

6. A canister purge control method for an internal combustion engine according to claim 1, wherein when a change quantity of said purge rate is greater than a predetermined value, an operational condition of said engine is determined as said transient operational condition.

7. A canister purge control apparatus for an internal combustion engine, including fuel vapor recovering means for temporarily recovering a fuel vapor generated in a fuel tank, means for purging said recovered fuel vapor to said engine during operation of said engine with a purge air quantity being controlled at a purge rate proportional to an air quantity supplied to said engine, and means for feedback controlling an air-fuel ratio; said apparatus comprising:

means for estimating a purge air-fuel ratio according to said purge rate and a feedback control quantity of said air-fuel ratio; and means for calculating a target air-fuel ratio feedback control quantity according to said purge air-fuel ratio estimated and said purge rate in a transient operational condition of said engine, and correcting said feedback control quantity of said air-fuel ratio according to said target air-fuel ratio feedback control quantity calculated.

8. A canister purge control apparatus for an internal combustion engine according to claim 7, wherein when a difference between said air-fuel ratio feedback control quantity and said target air-fuel ratio feedback control quantity is greater than a predetermined value, said air-fuel ratio feedback control quantity is corrected according to said target air-fuel ratio feedback control quantity calculated.

9. A canister purge control apparatus for an internal combustion engine according to claim 8, wherein said correcting of said air-fuel ratio feedback control quantity according to said target air-fuel ratio feedback control quantity calculated comprises adjusting of said air-fuel ratio feedback control quantity to said target air-fuel ratio feedback control quantity calculated.

10. A canister purge control apparatus for an internal combustion engine according to claim 9, wherein when a change quantity of said purge rate is greater than a predetermined value, an operational condition of said engine is determined as said transient operational condition.

11. A canister purge control apparatus for an internal combustion engine according to claim 8, wherein when a change quantity of said purge rate is greater than a predetermined value, an operational condition of said engine is determined as said transient operational condition.

12. A canister purge control apparatus for an internal combustion engine, including fuel vapor recovering means for temporarily recovering a fuel vapor generated in a fuel tank and recovered fuel purging means for purging said fuel vapor recovered by said fuel vapor recovering means to said engine during operation of said engine, said recovered fuel purging means including means for controlling a purge air quantity at a purge rate proportional to an air quantity supplied to said engine and means for feedback controlling an air-fuel ratio by using an air-fuel ratio sensor; said apparatus comprising:

means for calculating a purge air-fuel ratio according to said purge rate and a feedback control quantity of said air-fuel ratio in a normal operational condition of said engine; and feedback control quantity adjusting means for adjusting said air-fuel ratio feedback control quantity to a target air-fuel ratio feedback control quantity calculated according to said purge rate and said purge air-fuel ratio in a transient operational condition of said engine.

13. A canister purge control apparatus for an internal combustion engine according to claim 11, wherein said feedback control quantity adjusting means adjusts said air-fuel ratio feedback control quantity to said target air-fuel ratio feedback control quantity when a difference between said air-fuel ratio feedback control quantity and said target air-fuel ratio feedback control quantity is greater than a predetermined value.

14. A canister purge control apparatus for an internal combustion engine according to claim 11, wherein said correcting of said air-fuel ratio feedback control quantity according to said target air-fuel ratio feedback control quantity calculated comprises adjusting of said air-fuel ratio feedback control quantity to said target air-fuel ratio feedback control quantity calculated.

15. A canister purge control apparatus for an internal combustion engine according to claim 13, wherein when a change quantity of said purge rate is greater than a predetermined value, an operational condition of said engine is determined as said transient operational condition.

* * * * *